United States Patent [19]

Yovanofski

[11] Patent Number: 4,607,399

[45] Date of Patent: Aug. 26, 1986

[54] AUTOMATIC POOL WATER REGULATOR APPARATUS

[76] Inventor: Trayan Yovanofski, 607 Johnson Dr., Ormond Beach, Fla. 32074

[21] Appl. No.: 650,090

[22] Filed: Sep. 13, 1984

[51] Int. Cl.[4] ..... E04H 3/18

[52] U.S. Cl. ..... 4/508; 137/412; 137/423; 137/429; 137/453

[58] Field of Search ..... 4/506–510; 137/412, 423, 429, 453; 210/169

[56] References Cited

U.S. PATENT DOCUMENTS

| | | | |
|---|---|---|---|
| D. 274,972 | 8/1984 | Mann, Jr. | 200/331 |
| 956,030 | 4/1910 | Bennett | 137/412 |
| 1,179,537 | 4/1916 | Mapel | 137/412 |
| 1,348,016 | 7/1920 | Lee | 137/412 |
| 1,563,851 | 12/1925 | Hartman | 137/429 |
| 1,800,378 | 4/1931 | Everson | 4/508 |
| 2,738,675 | 3/1956 | Blair | 137/429 |
| 3,095,463 | 6/1963 | Chang et al. | 137/412 |
| 3,386,107 | 6/1968 | Whitten, Jr. | 4/508 |
| 3,759,286 | 9/1973 | Page | 4/508 |
| 4,133,059 | 1/1979 | Baker | 4/508 |
| 4,373,220 | 2/1983 | Selsted | 4/508 |

*Primary Examiner*—Stephen Marcus
*Assistant Examiner*—Linda J. Sholl
*Attorney, Agent, or Firm*—J. C. Wray

[57] ABSTRACT

A pool water regulator has two vertical pipes which indicate the pool water level. Each pipe has a floating element disposed therein, and each float element has a switch secured to a distal end protruding from the vertical pipes. Brackets are mounted adjacent the switches so that as the float elements rise and fall, the switches are turned ON and OFF thereby activating either pool draining or pool filling means.

8 Claims, 5 Drawing Figures

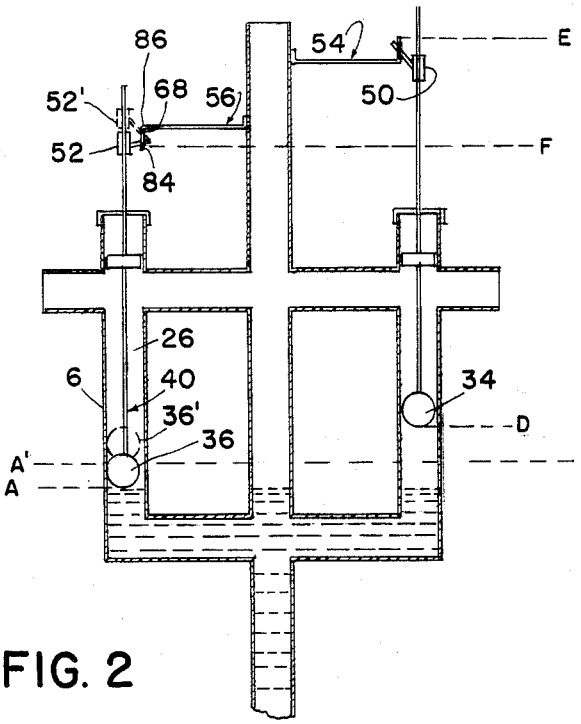
FIG. 2
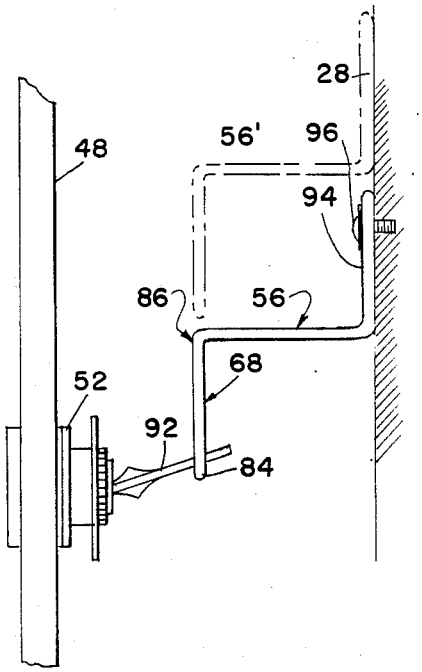
FIG. 4
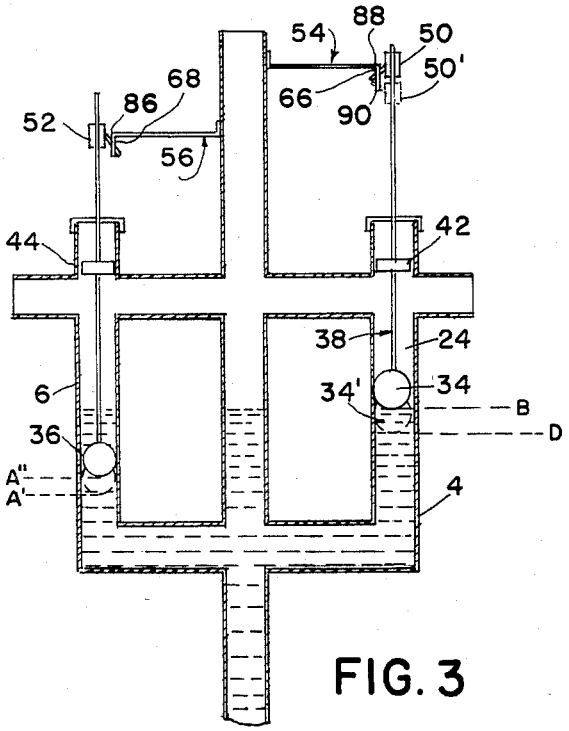
FIG. 3
FIG. 5
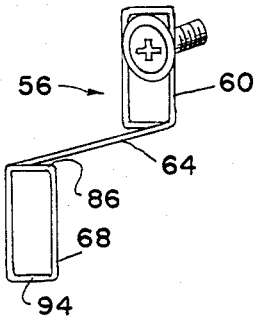

AUTOMATIC POOL WATER REGULATOR APPARATUS

BACKGROUND OF THE INVENTION

The present invention provides an automatic pool water level regulator for maintaining the pool water level within specified upper and lower limits.

One of the almost daily chores associated with pool maintenance is pool water level regulation. After a heavy rain, for instance, the pool water level may become so high that a skimmer-type filter recessed in the sides of the pool may become inoperative since floating debris can not enter the filter. Pool water level may fall below acceptable levels due to many factors including evaporation, splashing action and leakage. If the pool water is too low, floating debris also can not enter the skimmer-type filters. Ordinarily, a pool circulating system will have an intake positioned not far below the normal pool water level. If the pool water level falls below the intake level, the pump will draw in air, probably to the detriment of the circulating pump, and the pool water will not be able to circulate. Also, low pool water levels may also make swimming hazardous.

To overcome the problem of having a pool water level too high or too low, pool owners in the past have been required to manually add water in the event that the water level is too low or to manually drain water by opening a drain valve when the water level is too high. For in-ground type pools, draining the pool would further require pumping possibly through the circulating pump. Manual regulation is obviously disadvantageous since human presence and labor are required.

It is not uncommon to provide automatic fluid regulators using a mechanically connected float and valve apparatus. Examples of patents showing ordinary floats and valves are as follows:

U.S. Pat. No. 4,193,417
U.S. Pat. No. 2,767,552
U.S. Pat. No. 3,856,035
U.S. Pat. No. 3,633,610
U.S. Pat. No. 3,528,451
U.S. Pat. No. 2,930,393

None of these references are specifically applicable to swimming pools and none could be modified for use in conjunction with the swimming pools.

Patent No. 4,342,125 shows an apparatus for regulating pool water level automatically, but the apparatus is physically located within the pool. This presents obvious disadvantages including placing obstructions in the pool and restricting use of a pool ladder which is required for supporting the device in the pool. The apparatus does not have the means to remove water but can only add water. Also, the apparatus is relatively complicated and requires metal parts which can become corroded.

SUMMARY OF THE INVENTION

The present invention provides a low cost automatic pool water regulator which is easily installed, simple to operate and lightweight.

The apparatus may be constructed from ordinary plastic plumbing pipes, preferably two inches in diameter, and is not to be physically located in the pool. The regulator is to be located adjacent the pool and is connected to the pool by an inlet pipe which communicates water from the pool into the regulator.

For in ground type pools, the regulator may be partially buried in the ground beside the pool, or may be recessed in a well. For above ground type pools, the regulator could be easily mounted on an outside wall of the pool, with the top part extending above the pool water level.

In a prefered embodiment, the regulator has two vertical pipes which are interconnected by a horizontal base pipe to form a basic U-shaped structure. The U-shaped structure is connected at the base pipe to the pool by an inlet pipe which communicates water from the pool to the basic structure. The vertical pipes define float chambers which are capped at the upper ends thereof, each cap having a central outlet aperture for communicating air to the float chambers. It should be readily apparent that pool water will flow into the vertical pipes so that the pool water level and the two vertical pipe water levels will all coincide. The water level in the two vertical pipes will be indicative of the water level in the pool. The vertical pipes should extend upwardly beyond the sides of the pool to prevent the pool from draining through the vertical pipes.

Each of the vertical pipes is provided with a float member that rises and falls freely with changes in the water level of the pool. Each float member preferable consists of a round hollow plastic or other suitable material float which is attached to an upwardly extending lightweight actuator rod. The rod passes through a reducing sleeve disposed in an upper portion of each of the vertical pipes and also extends through the central outlet aperture to expose a portion of the rod outside each of the vertical pipes.

A switch is mounted near a distal end of each protruding actuator rod. The switches are toggle-type switches. Each switch has ON and OFF positions, one switch being electrically connected to a valve disposed in a water supply pipe and the other switch being electrically connected to pool draining means, which may include a draining pump or a valve disposed in a drain pipe. The former is necessary for in-ground pools, while the latter is preferable for above ground pools. The valves may be solenoid actuated.

It should be understood that the switches ride up and down with the float members depending on fluctuations in the water level.

Upper and lower limits for the water level of the pool are selected by mounting a bracket adjacent each of the switches. Each bracket is preferably formed of bent wire and comprises a horizontal mid-portion, a rectangular mounting portion, and a rectangular end-portion, the rectangular mounting portion and the rectangular end-portion are each mounted transverse the mid-portion and extend in opposite directions from each other. The rectangular portions lie at opposite ends of the mid portion in parallel vertical planes which are perpendicular to the horizontal plane of the mid portion. The rectangular mounting portion is used for mounting the bracket to a stationary support by drilling a hole in the support and screwing a screw tightly into the hole. The vertical level of the bracket can be adjusted by loosening the screw and sliding the bracket up or down to the extent of the length of the rectangular mounting portion.

The rectangular end portion need only be wide enough to receive a lever from the switch. The length of the rectangular end portion determines the amount of travel allowed for each float member within each of the vertical pipes.

A lower limit is determined by positioning one of the brackets relative to one of the switches such that when the water level falls to a minimum desired level, a lower portion of the rectangular end portion trips the switch to an ON position, thereby activating the water supply and increasing the pool level. As the pool level increases the float rises until an upper portion of the rectangular end portion trips the switch to an OFF position. Therefore, the lower limit is determined by the height of the lower portion of the rectangular end portion.

The upper limit of the water level is determined in a similar fashion to that of the lower limit except that the upper limit bracket is vertically positioned higher than the lower bracket and such that there is no overlap between rectangular end portions on respective brackets.

The upper bracket is positioned such that when the pool water level reaches a certain maximum level, the second switch is tripped to an ON position by an upper portion of the rectangular end portions associated with the second bracket, thereby activating the pool draining means. As the pool level decreases, the float falls to a point where a lower portion of the rectangular end portion trips the switch to an OFF position, thereby activating the pool draining means.

The pool water, therefore, is maintained between upper and lower limits by switches mounted on floats and tripped by stationary brackets. The range between upper and lower limits is determined by the distance between the upper and lower stationary brackets.

The apparatus includes a third vertical pipe placed between the first and second vertical pipes and the brackets are mounted on opposite sides of the third vertical pipe. Also, a transverse support pipe is provided to innerconnect and support the three vertical pipes. An additional transverse support pipe may be provided near a distal end of the third vertical pipe for housing miscellaneous electrical components. The additional transverse member necessarily must be spaced above the distal ends of the actuator rods.

The present apparatus may at least be partially integrated with a pool circulating system which normally comprises inlet pipes, outlet pipes and a circulating pump. The draining pump of the present invention may borrow the inlet pipe or the outlet pipe from the circulating system to draw water from the pool.

A BRIEF DESCRIPTION OF THE DRAWING

FIG. 2 is a plan view of the regulator shown in FIG. 1 in use at the lower limit of pool water level.

FIG. 3 is a plan view of the regulator shown in FIG. 1 is use at the upper limit of pool water level.

FIG. 4 is a cross sectional view showing in greater detail the switch and bracket used in the present invention.

FIG. 5 shows an exploded view of the bracket.

DETAILED DESCRIPTION OF THE DRAWINGS

Figure 1:
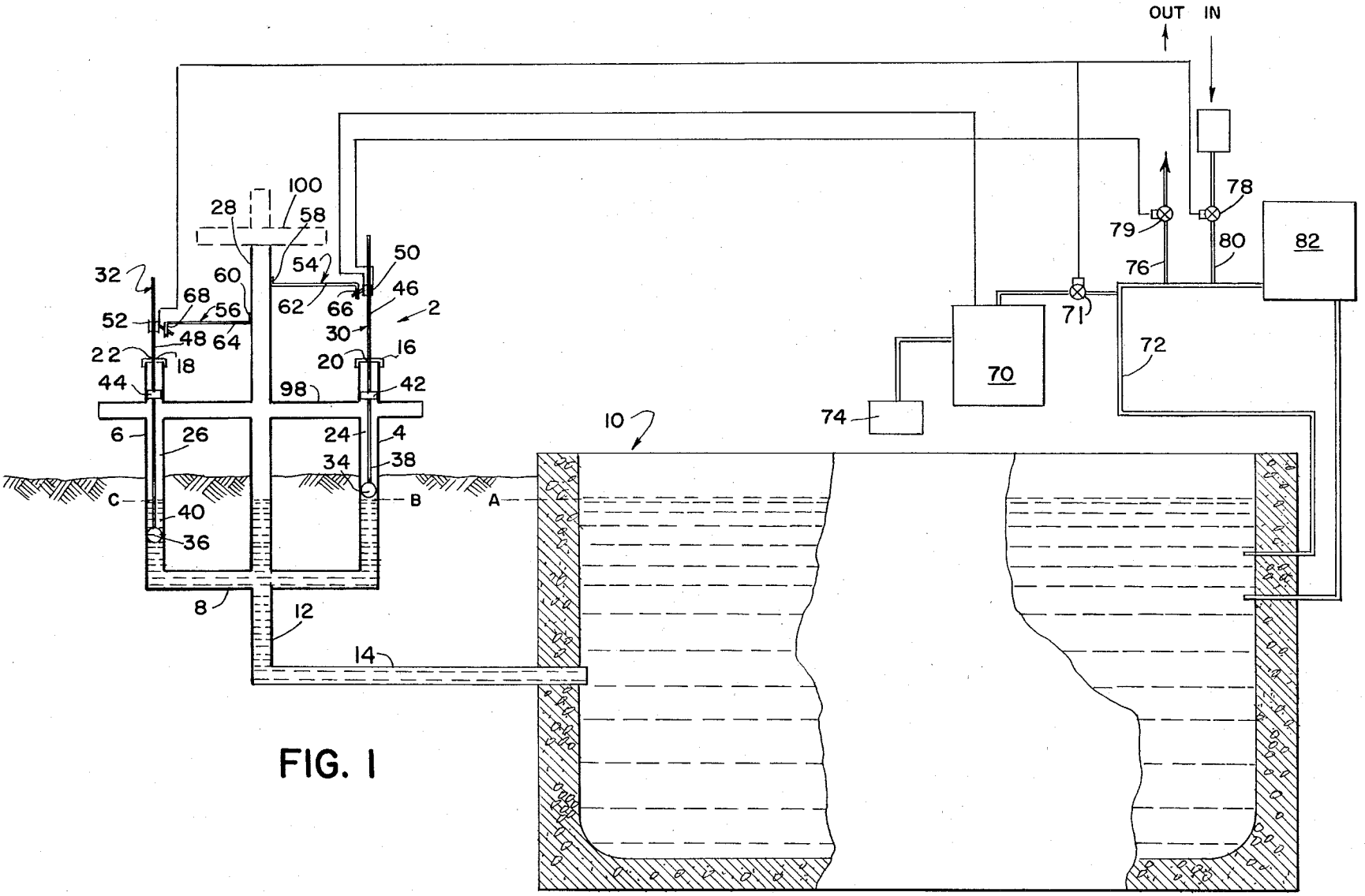
FIG. 1 is a schematic view of the regulator, pool and pool circulating system.

Refering to FIG. 1, the pool water regulator and regulator system are shown schematically. The regulator apparatus is shown generally as 2. The apparatus has two vertical pipes 4 and 6 which are interconnected by a horizontal base pipe 8. The apparatus is physically removed from the pool 10 but is interconnected to the pool by inlet pipe segments 12 and 14. The interconnection to the pool may be accomplished by a single horizontal inlet pipe.

Each vertical pipe 4 and 6 has a capped end portion 16 and 18 and each capped end portion has a central outlet aperture 20 and 22 for allowing the entry of air into the vertical pipes. The vertical pipes 4 and 6 define float chambers 24 and 26.

Water from the pool will communicate to the apparatus 2 through pipe segments 14 and 12 so that the water level of the pool denoted by the letter A will coincide with the water levels in the float chambers 24 and 26 denoted by the letters B and C respectively.

A third vertical pipe 28 is disposed between the vertical pipes 4 and 6 and is interconnected with the vertical pipes 4 and 6 at the horizontal base pipe 8. It is necessary for the vertical pipe 28 to be interconnected with vertical pipes 4 and 6 to help generate a fluid level within the vertical pipe 28 coincident with the water levels A, B and C.

Each float chamber 24 and 26 receives a float member 30 and 32. Each float member consists of a float 34 and 36 attached to an upwardly extending actuator rod 38 and 40. The actuator rods 38 and 40 pass through reducing sleeves 42 and 44 which help maintain the vertical position of the float members 30 and 32. The actuator rods 38 and 40 pass through the central outlet apertures 20 and 22 to reveal exposed portions 46 and 48 which extend beyond the distal ends of the vertical pipes 4 and 6.

Switches 50 and 52 are fixedly attached to the exposed portions 46 and 48 of the actuator rods 38 and 40. It can be appreciated that as the water level of the pool fluctuates, the switches 50 and 52 will rise and fall accordingly. The third vertical pipe 28 supports brackets 54 and 56 which are mounted to the third vertical pipe 28 by mounting portions 58 and 60. Mid-portions 62 and 64 extend radially outwardly and terminate in rectangular end portions 66 and 68.

Switch 50 is electrically connected to a pool draining pump 70 which pumps water from the pool through an inlet pipe 72 to a drain field 74 or other suitable disposal sites. The pump 70 is necessary for in ground type pools. For above ground pools, switch 50 may be electrically connected to a valve 79 disposed in a drain pipe 76, which upon opening, allows water to gravitate out. Both the pump 70 and the valve 79 may be used for above ground pools. When pump 70 is used, valve 71 must be employed to prevent circulating water from circulating pump 82 from draining out through the drain pump. Valve 71 should be electrically connected to the drain pump 70 and switch 50.

Switch 52 is electrically connected to a valve 78 disposed in a water supply pipe 80. Pump 82 is used to ordinarily circulate the pool water.

The operation of the regulator apparatus is illustrated in FIGS. 2 and 3. FIG. 2 shows operation at the lower limit of pool water level. When the pool water level is at level A′ which represents the minimum pool water level, float 36 shown in vertical pipe 6 and float chamber 26 descends to a level indicated by the solid line figure 36. At that point, switch 52 is tripped to an ON position by a lower portion 84 of the rectangular end portion 68 of the bracket 56. When the switch is tripped to an ON position as described, the water supply is activated and the pool begins to fill. As the pool fills, the float 36 will rise until the switch 52 is tripped to an OFF position by an upper portion 86 of the rectangular end portion 68 of the bracket 56. The rise in water level is indicated by the broken line water level A" and the float 36 is shown as a broken line figure 36'. Also switch 52 is shown in a broken line figure 52' in the elevated position. At the water level A" the entire float member 32 is restrained from moving further axially upwardly by the upper portion 86 of the rectangular end portion 68.

It should be noted that since the switch 50 is not meant to be activated except when a high water level limit is indicated, the float 34 will not begin to float until the pool water level increases to the level indicated by the broken line and letter D.

FIG. 3 illustrates operation at the upper limit of the pool water level. When the pool water level reaches the level indicated by the broken line and letter B, the float 34 in vertical pipe 4 and float chamber 24 reaches its maximum level and causes the switch 50 to be tripped to an on position by an upper portion 88 of the rectangular end portion 66 of the bracket 54. As previously explained, the switch can be electrically connected either of two different pool draining means. When the switch is tripped to an ON position, the pool draining means is activated and the pool water level will fall until the switch 50 is tripped to an OFF position by a lower portion 90 of the rectangular end portion 66 of the bracket 54. The water level falls from level B to the level indicated by the broken line and letter D. The float 34 is shown in a declined position in a broken line Figure 34' as well as the switch 50'. When the float 34 reaches the level D, the entire float member 30 is restrained from further axially downwardly movement by the bracket 54. Therefore, refering back to FIG. 2, if the water level falls anywhere below level D float 34 will be suspended above the water level indicated in vertical tube 4.

Refering back to FIG. 3, when the water level is above A", the float 36 in vertical pipe 6 will become submerged as the water level increases since the switch 52 is prevented from moving further upwardly by the upper portion 86 of the rectangular end portion 68 of the bracket 56. Therefore, when the float 34 shown in FIG. 3 attains the level indicated by broken line and letter B, float 36 will be submerged.

It should be further noted that switches 50 and 52 are identical except for having inverted ON and OFF positions. The operation of the switch in relation to the bracket is shown in greater detail in FIG. 4.

In FIG. 4 switch 52 is shown having a lever portion 92 which is tripped by a lower portion 84 of the rectangular end portion 68. When the switch is tripped to an ON position as indicated in FIG. 4, the lever portion 92 angles upwardly. The switch 52 and actuator rod 48 rise with an increase in the pool water level until the upper portion 86 of the rectangular end portion 68 of the bracket 56 trips the switch 52 to an OFF position. In an OFF position, the lever 92 angles downwardly.

The bracket 56 has a rectangular mounting portion 94 for securing the bracket 56 to the third vertical pipe 28. Screw 96 secures the bracket 56 to the vertical pipe 28 and when the screw 96 is loosened the bracket 56 can be adjusted vertically by sliding the bracket along the vertical pipe 28. Broken line Figure 56' shows the bracket in an axially translated position. The operation of switch 50 and bracket 54 is similar to the operation of switch 52 and bracket 56 except that bracket 54 is mounted vertically higher than bracket 56.

Refering back to FIG. 2 the range between the lower limit and the upper limit of the pool water level is illustrated as the distance between level E and level F. Level E indicates the vertical level of the upper portion 88 of the rectangular end portion 66 of bracket 54 and level F illustrates the level of the lower portion 84 of the rectangular end portion 68 of bracket 56. The range between the upper and lower limits can be increased or decreased by imparting relative axial movement between the brackets 54 and 56. In order to prevent the pool draining means from operating immediately upon filling the pool, it is preferable not to have the brackets 54 and 56 coexisting in the same horizontal plane. Also there should be no overlap between the rectangular end portions 66 and 68 of the brackets 54 and 56 respectively in order to prevent simultaneous operations of pool filling and pool draining.

FIG. 5 shows a prefered embodiment of the bracket 56 having a mid-portion 64, a rectangular mounting portion 60 and a rectangular end portion 68. It should be understood that bracket 54 would have an identical shape but would be mounted diametrically opposite the bracket 56. It should also be understood that the allowable length of travel for the float member 32 would be determined by the length of rectangular end portion 68. Also the adjustment capability of the bracket 56 will be determined by the length of rectangular mounting portion 60.

The actuator rods 46 and 48 are preferably constructed of $\frac{3}{8}$ inch PVC tubing. It is important for the actuator rods 46 and 48 not to be too heavy or too light. The floats 34 and 36 are preferably round and constructed of hollow plastic or similar other lightweight material.

In an prefered embodiment of the regulator apparatus, a transverse type segment 98 interconnects vertical pipes 4, 6 and 28 and provides additional support for the three vertical pipes. It may be desirable to provide an additional transverse pipe 100 shown by a broken line figure in FIG. 1 for housing electrical components.

The system is designed to operate on either 110 volts or 220 volts, with a step down transformer to 24 volts located in the line. This feature renders the invention safe from electrical shock and less expensive to operate. Also, lighter materials can be used which enables easy vertical movement of the float members.

All solenoid values operate on Low Voltage (24 V) for safety reasons. Switch 50 is also low voltage activated while pump 70 is 110 volts.

While the invention has been described with reference to specific embodiments, the exact nature and scope of the invention is described in the following claims.

I claim:

1. A pool water level regulating apparatus installed adjacent a pool, the apparatus comprising:

a first vertical pipe, a second vertical pipe, a third vertical pipe positioned between the first and second vertical pipes, the first, second and third vertical pipes being interconnected with each other and the pool so that the water level of the pool corresponds to a water level in each of the first, second and third vertical pipes, a first float member axially movable inside the first vertical pipe, a second float member axially movable inside the second vertical pipe, a first bracket mounted on a side of the third vertical pipe and facing the first vertical pipe, a second bracket mounted on the opposite side of the third vertical pipe and facing the second vertical pipe and being vertically spaced above the first bracket, a first switch fixedly mounted near a distal end of the first float member, a second switch fixedly mounted near a distal end of the second float member, the first switch being electrically connected to means for increasing the water level of the pool, the second switch being electrically connected to means for decreasing the water level in the pool, the first bracket moving the first switch to an ON position when the pool level falls to a lower limit and moving the first switch to an OFF position when the pool level falls below the upper limit, wherein the first, second and third vertical pipes are assembled together from segments of plastic pipe, and the assembly is disposed in spaced relation to the pool.

2. The apparatus of claim 1 wherein the first and second brackets are axially adjustable along the third vertical pipe and the upper and lower limits of the pool level are determined by the distance between the first and second brackets.

3. The apparatus of claim 1 wherein the first and second float members comprise a float and an actuator rod extending upwardly from the float, a portion of the actuator rod extending beyond the first and second vertical pipes, the first and second switches being fixedly mounted near a distal end of the actuator rods.

4. The apparatus of claim 1 further comprising:

reducing sleeves disposed within an upper portion of each of the first and second vertical pipes for maintaining the vertical position of the float member, and a transverse pipe mounted to the vertical pipe for supporting the first and second vertical pipes.

5. The apparatus of claim 1 wherein the first and second switches are toggle switches.

6. The apparatus of claim 1 wherein the means for decreasing water level comprises a draining pump having an inlet connected to a pool circulating network.

7. A water level regulating system for maintaining the water level in a swimming pool between the upper and lower limits comprising:

water supply means for increasing the pool water level, draining means for decreasing the pool water level, float means for floating on water, switch means attached to the float means for moving as the float means moves and for alternately activating the water supply means and the draining means when the switch means is switched, bracket means for contacting the switch means and switching the switch means as the switch means moves with respect to the bracket means, support means connected to the bracket means for supporting the bracket means adjacent the switch means, and water communicating means for communicating water from the pool to the float means so that as the pool water level rises or falls, the float means and the switch means rise or fall accordingly and cause the bracket means to trip the switch means for alternately raising or lowering the water level in the swimming pool, the draining means comprising a draining pump having an intake connected to a pool circulating pump intake, the draining pump intake pipe having a valve disposed therein and being activated when the circulating pump is turned on to prevent circulating water from flowing out of the pool through the draining pump, the switch means comprising two toggle switches fixedly mounted at distal ends of the float means, one of the two toggle switches being electrically connected to the water supply and one of the two toggle switches being electrically connected to the draining means, the support means comprising a vertical tube, a first horizontal bracket mounted on a side and near a distal end of the vertical tube and a second horizontal bracket mounted on an opposite side of the vertical tube and being vertically spaced above the first horizontal bracket, the first and second horizontal brackets having vertical slot portions at a near end of each bracket for receiving a screw for adjustably mounting the near end of the bracket to the vertical tube, and a vertical slot at the far end of the bracket for receiving the switch means, the system further comprising an upper horizontal pipe for supporting upper portions of the float means and a lower horizontal pipe for supporting lower portions of the float means, the lower horizontal pipe interconnecting the float means, the vertical tube and the water communicating means, the float means comprising first and second float chambers, each float chamber containing a water level corresponding to the water level of the pool, a float floating on the water level in the float chambers, an actuator rod connected to the float and extending upwardly through and beyond the float chamber and passing through a reducing sleeve provided near the end of the distal float chamber to maintain the actuator rods centrally in the float chamber, the switch means being fixedly mounted near a distal end of the actuator rod, and the water communicating means comprising a pipe segment interconnecting the swimming pool with the float means and support means.

8. A pool water regulator made of an assembly of plastic pipes and being separately mounted from the pool comprising, two vertical pipes interconnected at bottom ends thereof with a horizontal base pipe, an inlet pipe disposed between the pool and the base pipe, water from the pool being communicated to the two vertical pipes through the inlet pipe and the base pipe, whereby the water level of the pool is transmitted to and equals the water level in the two vertical pipes, a float disposed in each vertical pipe and being axially movable in response to changes in water level, an elongated rod extending upwardly from each float and having an upper end portion extending beyond an upper axial end of each vertical pipe, a switch fixedly mounted to the upper end portion of each elongated rod, one switch being electrically connected to means for draining the pool, and the other switch being electrically connected to means for filling the pool both switches being Toggle-type switches with projecting levers for turning on and off the means for draining and filling the pool, a bracket mounted adjacent each switch on diametrically opposite sides of a vertical support member disposed between the two vertical pipes, one bracket being mounted lower than the other bracket, each bracket having a rectangular proximal end portion and a rectangular distal end portion, the rectangular distal end portion defining a rectangular space through which the switch lever extends, whereby the lower bracket turns on and off the switch electrically connected to the means for filling the pool, and the upper bracket turns on and off the switch electrically connected to the means for draining the pool.

* * * * *